US010172492B2

(12) United States Patent
Cobb

(10) Patent No.: US 10,172,492 B2
(45) Date of Patent: Jan. 8, 2019

(54) ADJUSTABLE INSERT FOR DOOR MAIL SLOT

(71) Applicant: BOTA, Inc., Denver, CO (US)

(72) Inventor: Dalanda Cobb, Denver, CO (US)

(73) Assignee: BOTA, Inc., Denver, CO (US)

( * ) Notice: Subject to any disclaimer, the term of this patent is extended or adjusted under 35 U.S.C. 154(b) by 144 days.

(21) Appl. No.: 14/993,125

(22) Filed: Jan. 12, 2016

(65) Prior Publication Data

US 2016/0206125 A1 Jul. 21, 2016

Related U.S. Application Data

(60) Provisional application No. 62/103,814, filed on Jan. 15, 2015.

(51) Int. Cl.
*A47G 29/126* (2006.01)

(52) U.S. Cl.
CPC ..... *A47G 29/126* (2013.01)

(58) Field of Classification Search
CPC .... A47G 29/126; A47G 29/1245; A47G 1/08; B60R 13/105; B66B 13/308
USPC ..... 232/44, 45, 19; 40/209, 741; 49/475.1
See application file for complete search history.

(56) References Cited

U.S. PATENT DOCUMENTS 1,540,482 A * 6/1925 Landaal ..... A47G 1/08 40/741
1,548,249 A * 8/1925 Binns ..... A47G 1/08 40/741
1,578,357 A * 3/1926 Parkins ..... B60R 13/105 40/209
1,857,141 A * 5/1932 Corley ..... B60R 13/105 40/209
2,078,744 A * 4/1937 Tursky ..... A47G 1/08 40/741
2,138,124 A * 11/1938 Schnell ..... B60R 13/105 40/209
2,250,263 A * 7/1941 Horwitt ..... A47G 1/08 40/764
2,437,319 A 3/1948 Gabel et al.
2,442,967 A * 6/1948 Barrett ..... A47G 1/08 40/742
2,790,259 A * 4/1957 Havens ..... A47G 1/08 40/741
2,866,286 A * 12/1958 Hartman ..... A47G 1/08 40/741

(Continued)

FOREIGN PATENT DOCUMENTS

GB 2038621 A 7/1980
GB 2094141 B 12/1984

(Continued)

*Primary Examiner* — William L Miller
(74) *Attorney, Agent, or Firm* — The Webb Law Firm

(57) ABSTRACT

An adjustable mail slot insert may include two top frame members connected to one another and two bottom frame members connected to one another. Each bottom frame member may include a side leg and a bottom leg. Each top frame member may include a side leg and a top leg. One top frame member may be connected to one bottom frame member and another top frame member may be connected to another bottom frame member. The insert may be adjustable in a horizontal direction and a vertical direction through movement of the frame members relative to one another.

16 Claims, 15 Drawing Sheets

(56) References Cited

U.S. PATENT DOCUMENTS 3,451,153 A * 6/1969 Dohanyos ..... A47G 1/08 40/741
3,465,461 A * 9/1969 Herbert ..... A47G 1/08 40/209
3,567,112 A 3/1971 Wittekind
4,545,522 A 10/1985 Kerzner
5,448,841 A * 9/1995 Hampton ..... A47G 1/065 40/730
5,579,596 A * 12/1996 Kovacs ..... A47G 1/08 40/739
6,377,320 B1 * 4/2002 Ananian ..... G06F 1/1609 312/7.2
6,898,886 B1 * 5/2005 Montecalvo ..... A47G 1/0616 40/740
7,451,912 B1 * 11/2008 Taube, II ..... A47G 29/1209 232/17
9,839,314 B2 * 12/2017 De La Nuez .... A47G 29/12097
2004/0128894 A1 * 7/2004 Sachs-Lavery ..... A47G 1/08 40/741
2006/0022028 A1 * 2/2006 Thomas ..... A47G 29/1209 232/29
2007/0028543 A1 * 2/2007 Lachance ..... A47G 29/126 52/317
2008/0209787 A1 * 9/2008 Alcov ..... A47G 1/08 40/742
2009/0193692 A1 * 8/2009 Lipczynski ..... G09F 1/10 40/1
2010/0083581 A1 * 4/2010 Mattice ..... B66B 13/308 49/475.1
2015/0282359 A1 * 10/2015 Raccah ..... H05K 5/03 40/741

FOREIGN PATENT DOCUMENTS

GB 2291680 B 10/1997
GB 2426998 B 8/2009
GB 2502809 A 12/2013
GB 2515065 A 12/2014
GB 2525707 A 8/2016

* cited by examiner

ADJUSTABLE INSERT FOR DOOR MAIL SLOT

CROSS REFERENCE TO RELATED APPLICATION

This application claims the benefit of U.S. Provisional Patent Application No. 62/103,814, filed on Jan. 15, 2015, the disclosure of which is incorporated by reference in its entirety.

BACKGROUND OF THE INVENTION

Field of the Invention

This disclosure relates generally to inserts for mail slots and, more particularly, to an adjustable insert for a door mail slot.

Description of Related Art

Inserts for mail slots are well known in the art and have been used in many different types of environments, such as doors, windows, or walls. The inserts are typically provided in a slot defined or cut-out of the particular object, such as a door. The insert is often positioned in the cut-out via a friction fit, adhesive, or fastener. The insert is provided in a tight, snug fitting within the door such that the insert is provided flush against the door. The insert will often also include a door or hinged member that covers either the front or rear opening of the insert to protect against cold or hot air, odors, small particles, or similar objects from entering the building via the mail slot insert.

It is common practice to provide mail slot inserts that are manufactured in pre-defined dimensions according to the dimensions of the mail slots typically cut out in doors. Presently, however, doors are increasingly provided with a variety of dimensions for the mail slot. Due to aesthetic purposes, different doors include different sized mail slots. Therefore, in the event an individual purchases a new door in his/her house or office building, the individual is most likely required to obtain a new mail slot insert for the new door according to the new dimensions of the mail slot. Problems arise, however, when an individual attempts to use a smaller mail slot insert that does not fit into the mail slot cut out of the door. In this situation, air gaps are created between the outer edges of the mail slot insert and the mail slot itself. Cold and/or hot air is then permitted to flow through the air gaps into the building. Eventually, the individual may need to provide insulation in the mail slot to prevent the passage of air into the building or will need to buy a new mail slot insert that has the same dimensions as the new mail slot.

SUMMARY OF THE INVENTION

In view of the foregoing, a need exists for a mail slot insert that can be used in any door regardless of the dimensions of the mail slot that is cut out of the door. A further need exists for a mail slot insert that can be adjusted to fit into any mail slot. A further need exists for a mail slot that can provide an air tight passage that prevents hot and/or cold air from flowing into the building.

In one aspect, an adjustable mail slot insert may include two top frame members connected to one another and two bottom frame members connected to one another. Each bottom frame member may include a side leg and a bottom leg. Each top frame member may include a side leg and a top leg. One top frame member may be connected to one bottom frame member and another top frame member may be connected to another bottom frame member. The insert may be adjustable in a horizontal direction and a vertical direction through movement of the frame members relative to one another.

A top adjusting member may extend between the top legs of the top frame members. A bottom adjusting member may extend between the bottom legs of the bottom frame members. A right side adjusting member may extend between the right side legs of the top frame member and the bottom frame member. A left side adjusting member may extend between the left side legs of the top frame member and the bottom frame member. The side leg of one of the top frame members may include a first protrusion extending therefrom. The side leg of the other top frame member may define a first channel therein. The side leg of one of the bottom frame members may include a second protrusion extending therefrom. The side leg of the other bottom frame member may define a second channel therein. The first protrusion may be inserted into the second channel. The second protrusion may be inserted into the first channel. The top leg of one of the top frame members may define a first channel therein. The top leg of the other top frame member may include a first protrusion extending therefrom. The bottom leg of one of the bottom frame members may include a second protrusion extending therefrom. The bottom leg of the other bottom frame member may define a second channel therein. The first protrusion may be inserted into the first channel. The second protrusion may be inserted into the second channel. At least one brush attachment may be positioned on at least one of the top frame members and the bottom frame members. The at least one brush attachment may be positioned across the top frame members or the bottom frame members. A brush attachment may be positioned on each top frame member and each bottom frame member. The brush attachments may be offset relative to one another when positioned in the adjustable mail slot insert. At least one brush holder may hold the at least one brush attachment on at least one of the top frame members and the bottom frame members. The at least one brush holder may define a channel to receive and retain the at least one brush attachment within the at least one brush holder. The at least one brush attachment may be removably positioned on at least one of the top frame members and the bottom frame members. The adjustable mail slot insert may have a substantially rectangular cross-section. A height and width of the adjustable mail slot insert may be adjustable. The top frame members and the bottom frame members may be substantially L-shaped.

In another aspect, a method of adjusting a mail slot insert may include a) providing an adjustable mail slot insert, including a frame having a first frame member, a second frame member, a third frame member, and a fourth frame member; and, either b) moving the first frame member and the third frame member of the frame relative to one another to adjust the height of, the frame; or c) moving the second frame member and the fourth frame member of the frame relative to one another to adjust the width of the frame. The adjustable mail slot insert may include at least one adjusting member positioned on each portion of the frame.

Accordingly, and generally, an adjustable mail slot insert and a method of adjusting the mail slot insert are provided to address and/or overcome some or all of the deficiencies or drawbacks associated with existing mail slot inserts.

DESCRIPTION OF THE DISCLOSURE

Figure 1:
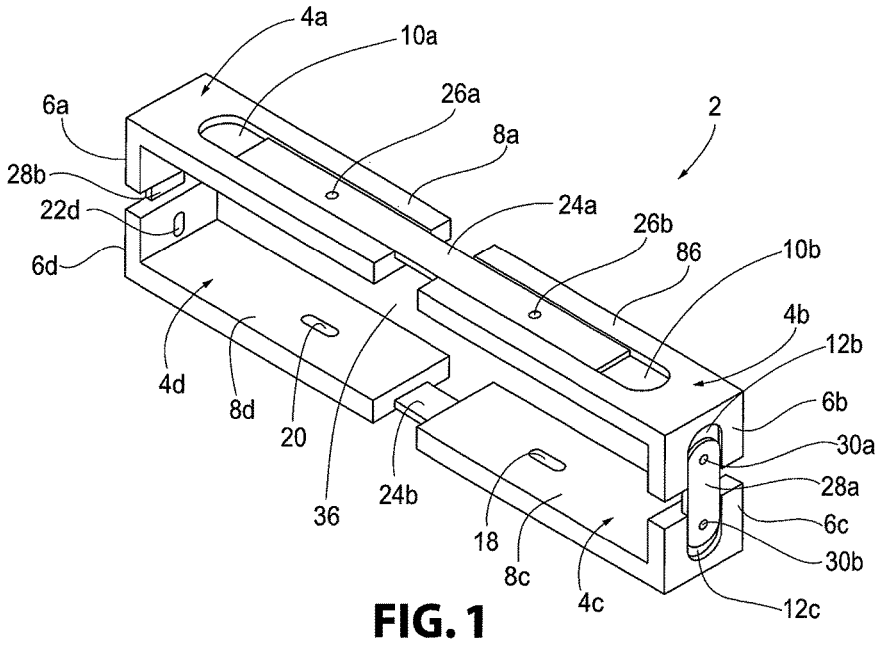
FIG. 1 is a front perspective view of an adjustable mail slot insert in accordance with one aspect of this disclosure.
Figure 2:
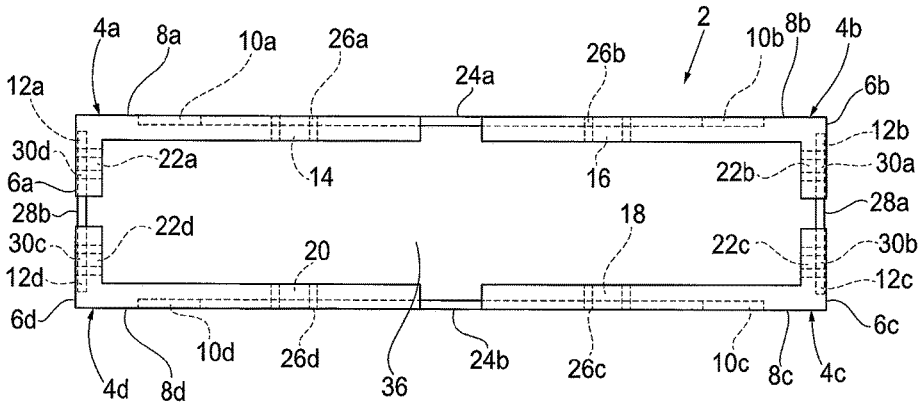
FIG. 2 is a front view of the adjustable mail slot insert of FIG. 1.
Figure 3:
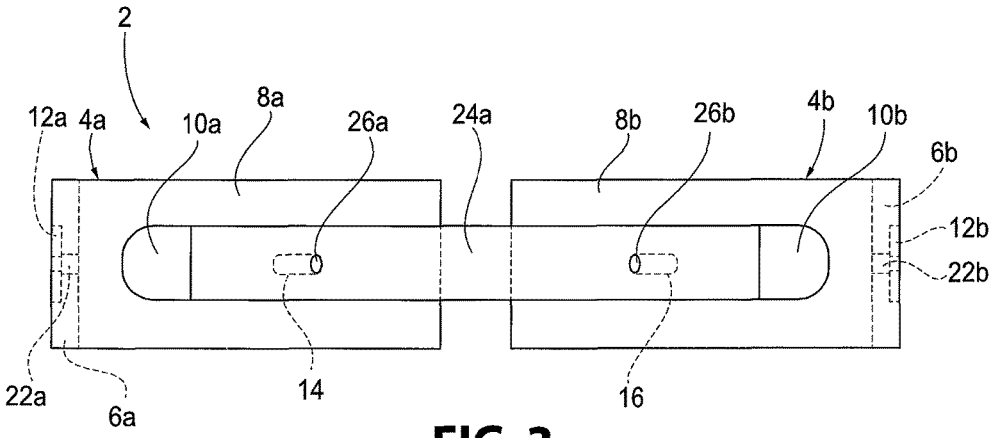
FIG. 3 is a top view of the adjustable mail slot insert of FIG. 1.
Figure 4:
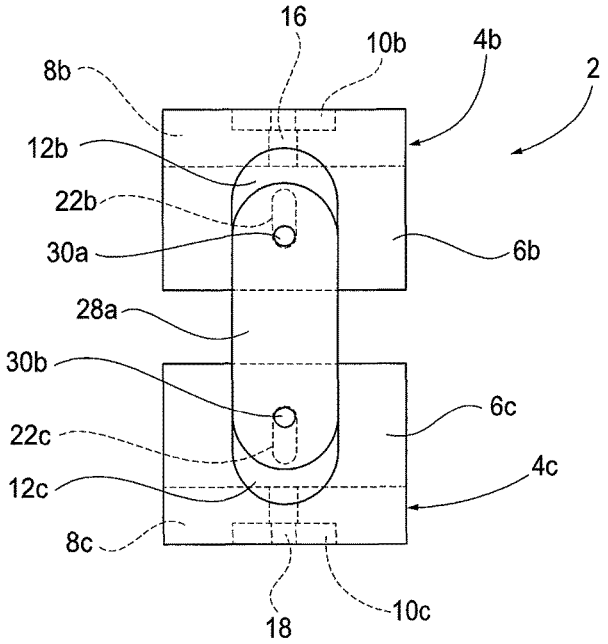
FIG. 4 is a side view of the adjustable mail slot insert of FIG. 1.

For purposes of the description hereinafter, the terms "upper", "lower", "right", "left", "vertical", "horizontal", "top", "bottom", "lateral", "longitudinal", and derivatives thereof shall relate to the invention as it is oriented in the drawings. However, it is to be understood that the invention may assume alternative variations and step sequences, except where expressly specified to the contrary. It is also to be understood that the specific devices and processes illustrated in the attached drawings, and described in the following specification, are simply exemplary aspects of the invention. Hence, specific dimensions and other physical characteristics related to the aspects disclosed herein are not to be considered as limiting.

The present disclosure is directed to, in general, a mail slot insert and, in particular, to an adjustable mail slot insert for a door. Certain preferred and non-limiting aspects of the components of the adjustable mail slot insert are illustrated in FIGS. 1-24.

With reference to FIGS. 1-4, an adjustable mail slot insert 2 (hereinafter referred to as "insert 2") is shown. The insert 2 is desirably adapted for use in a door of a residential home, office building, or post office. However, it is to be understood that the insert 2 may be used in various other environments, such as a window or an opening defined in a wall. The insert 2 is formed from four separate frame members, 4*a*-4*d*. In one aspect, the insert 2 may be made of plastic or a plastic-like material. It is also contemplated that the insert 2 may be made from alternative types of materials, such as metal. Although the insert 2 is shown with four frame members 4*a*-4*d*, it is to be understood that the insert 2 may be made with only two frame members. In one aspect, the four frame members 4*a*-4*d* may be substantially "L-shaped" so as to form a substantially rectangular insert 2. It is also contemplated that the frame members 4*a*-4*d* may form a substantially square insert. Each frame member 4*a*-4*d* may include a side leg 6*a*-6*d*, respectively. The first and second frame members 4*a*, 4*b* may also include a top leg 8*a*, 8*b* that extends substantially perpendicular to the side legs 6*a*, 6*b*. In one aspect, the side legs 6*a*, 6*b* may be shorter than the top legs 8*a*, 8*b*. The third and fourth frame members 4*c*, 4*d* may also include a bottom leg 8*c*, 8*d* that extends substantially perpendicular to the side legs 6*c*, 6*d*. In one aspect, the side legs 6*c*, 6*d* may be shorter than the bottom legs 8*c*, 8*d*.

The top legs 8*a*, 8*b* may each define a channel 10*a*, 10*b* that extends from one end of the top leg 8*a*, 8*b* to an opposing end of the top leg 8*a*, 8*b*. In one aspect, one end of the channel 10*a*, 10*b* is rounded. Likewise, the bottom legs 8*c*, 8*d* may each define a channel 10*c*, 10*d* that extends from one end of the bottom leg 8*c*, 8*d* to an opposing end of the bottom leg 8*c*, 8*d*. In a similar fashion, the side legs 6*a*-6*d* may each define a channel 12*a*-12*d*.

The first top leg 8*a* may define at least one aperture 14 configured to receive a retaining member (not shown), such as a pin, screw, or bolt. The second top leg 8*b* may define at least one aperture 16 configured to receive a retaining member (not shown), such as a pin, screw, or bolt. The first bottom leg 8*c* may define at least one aperture 18 configured to receive a retaining member (not shown), such as a pin, screw, or bolt. The second bottom leg 8*d* may define at least one aperture 20 configured to receive a retaining member (not shown), such as a pin, screw, or bolt. Each of the side legs 6*a*-6*d* may define at least one aperture 22*a*-22*d*, respectively, configured to receive a retaining member (not shown), such as a pin, screw, or bolt. It is to be understood, however, that more than two apertures may be defined in each of the frame members 4*a*-4*d*. It is to be understood that the apertures may also be considered or formed as elongated slots.

Figure 5:
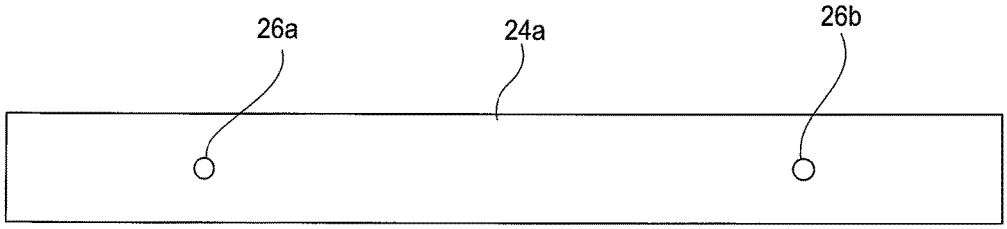
FIG. 5 is a top view of an adjusting member used in the adjustable mail slot insert of FIG. 1.

The insert 2 may also include an upper adjusting member 24*a* and a lower adjusting member 24*b*. As shown in FIG. 5, the upper and lower adjusting members 24*a*, 24*b* may be substantially rectangular. As shown in FIG. 1, the upper adjusting member 24*a* may extend from the first channel 10*a* to the second channel 10*b* defined on the top legs 8*a*, 8*b*. Likewise, the lower adjusting member 24*b* may extend from the third channel 10*c* to the fourth channel 10*d* defined on the bottom legs 8*c*, 8*d*. The upper adjusting member 24*a* may define at least two apertures 26*a*, 26*b*. One aperture 26*a* may be positioned over the first top leg 8*a*. Another aperture 26*b* may be positioned over the second top leg 8*b*. The lower adjusting member 24*b* may also define at least two apertures 26*c*, 26*d*. One aperture 26*c* may be positioned over the first bottom leg 8*c*. Another aperture 26*d* may be positioned over the second bottom leg 8*d*. It is also contemplated that more than two apertures may be defined in each of the upper and lower adjusting members 24*a*, 24*b*.

During operation of the insert 2, the aperture 26*a* of the upper adjusting member 24*a* may be positioned in line with the aperture 14 defined in the first top leg 8*a*. A retaining member (not shown) may be inserted through the apertures 14, 26*a* to hold the first top leg 8*a* and upper adjusting member 24*a* together. The retaining member may be freely slidable within the aperture 14 so as to permit the lateral or horizontal movement of the upper adjusting member 24*a* relative to the first top leg 8*a*. In a similar manner, the aperture 26*b* of the upper adjusting member 24*a* may be positioned in line with the aperture 16 defined in the second top leg 8*b*. A retaining member (not shown) may be inserted through the apertures 16, 26*b* to hold the second top leg 8*b* and upper adjusting member 24*a* together. The retaining member may be freely slidable within the aperture 16 so as to permit the lateral or horizontal movement of the upper adjusting member 24*a* relative to the second top leg 8*b*.

During operation of the insert 2, the aperture 26*c* of the lower adjusting member 24*b* may be positioned in line with the aperture 18 defined in the first bottom leg 8*c*. A retaining member (not shown) may be inserted through the apertures 18, 26*c* to hold the first bottom leg 8*c* and the lower adjusting member 24*b* together. The retaining member may be freely slidable within the aperture 18 so as to permit the lateral or horizontal movement of the lower adjusting member 24*b* relative to the first bottom leg 8*c*. In a similar manner, the aperture 26*d* of the lower adjusting member 24*b* may be positioned in line with the aperture 20 of the second bottom leg 8*d*. A retaining member (not shown) may be inserted through the apertures 20, 26*d* to hold the second bottom leg 8*d* and the lower adjusting member 24*b* together. The retaining member may be freely slidable within the aperture 20 so as to permit the lateral or horizontal movement of the lower adjusting member 24*b* relative to the second bottom leg 8*d*.

Figure 6:
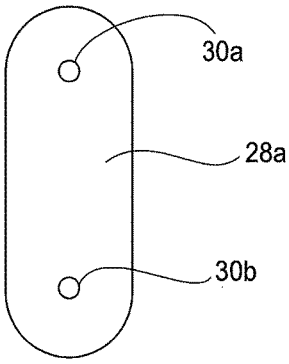
FIG. 6 is a top view of another adjusting member used in the adjustable mail slot insert of FIG. 1.
Figure 7:
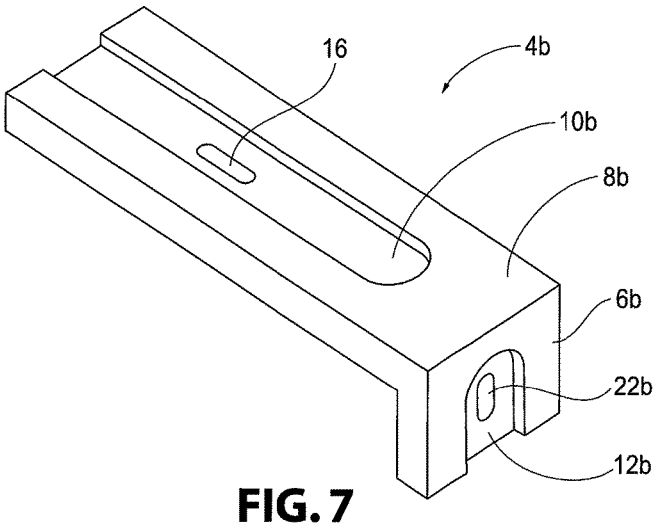
FIG. 7 is a front perspective view of a frame member of the adjustable mail slot insert of FIG. 1.
Figure 8:
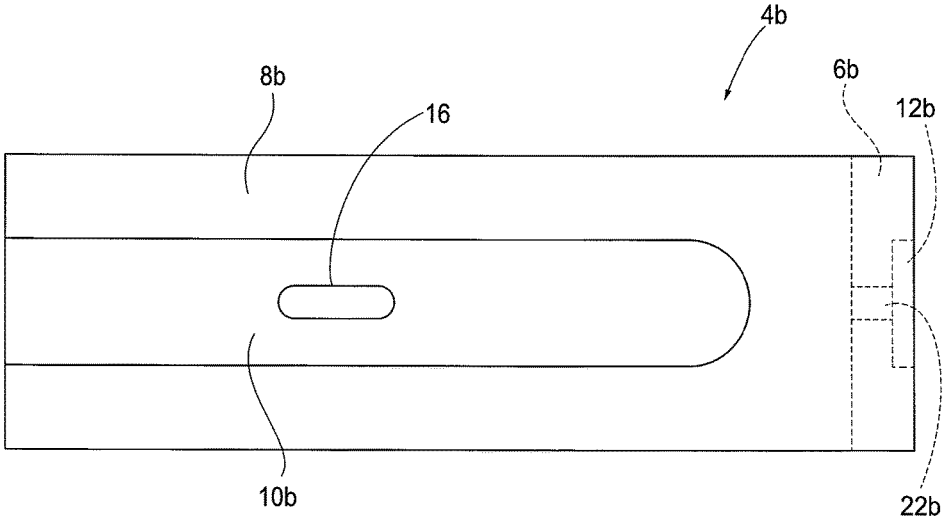
FIG. 8 is a top view of the frame member of FIG. 7.
Figure 9:
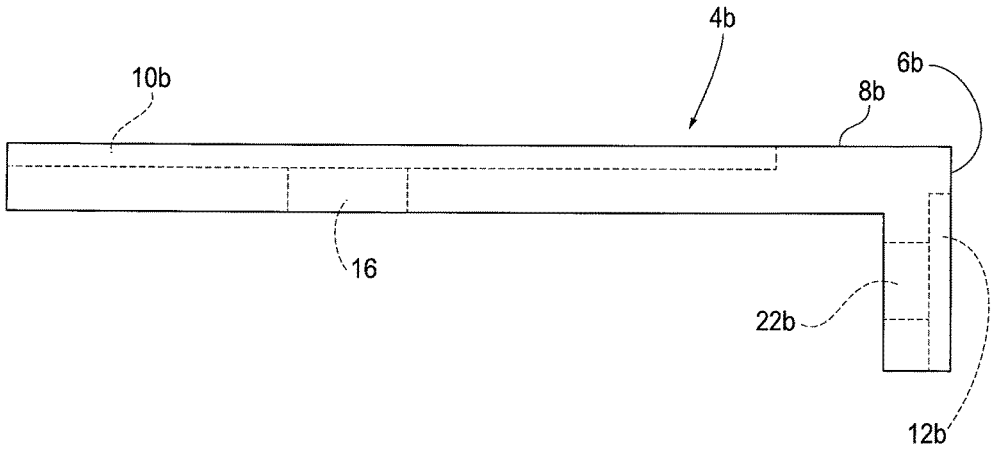
FIG. 9 is a front view of the frame member of FIG. 7.
Figure 10:
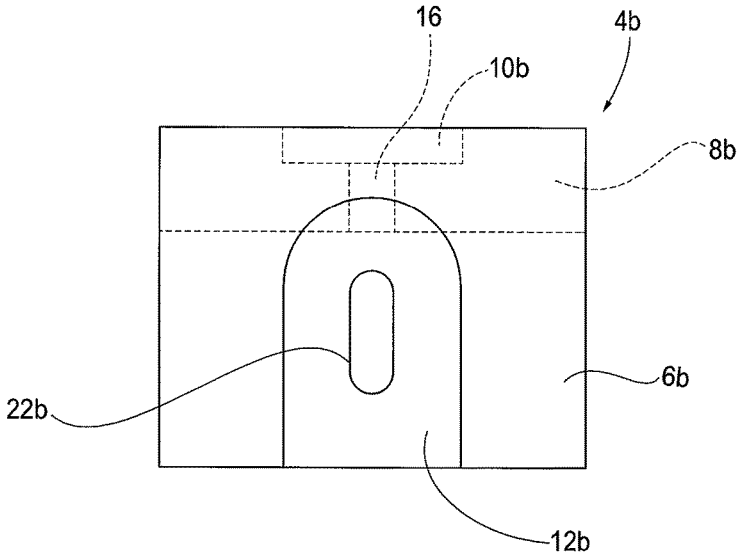
FIG. 10 is a side view of the frame member of FIG. 7.
Figure 11:
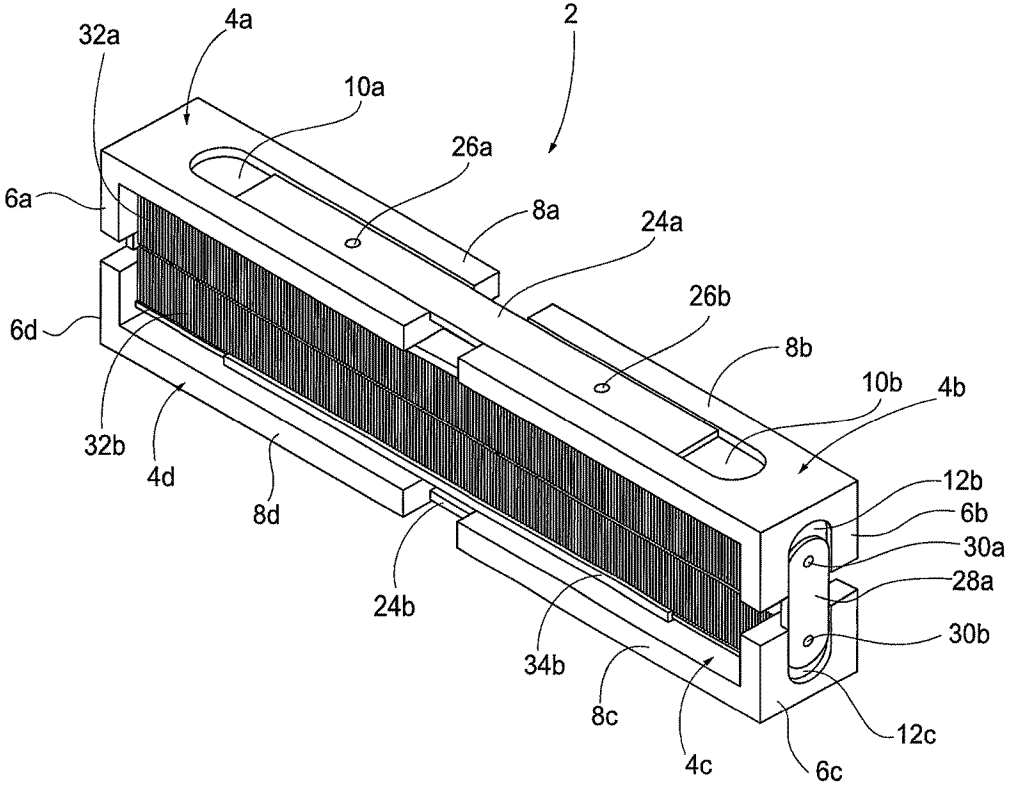
FIG. 11 is a front perspective view of the adjustable mail slot insert of FIG. 1 including a brush attachment.
Figure 12:
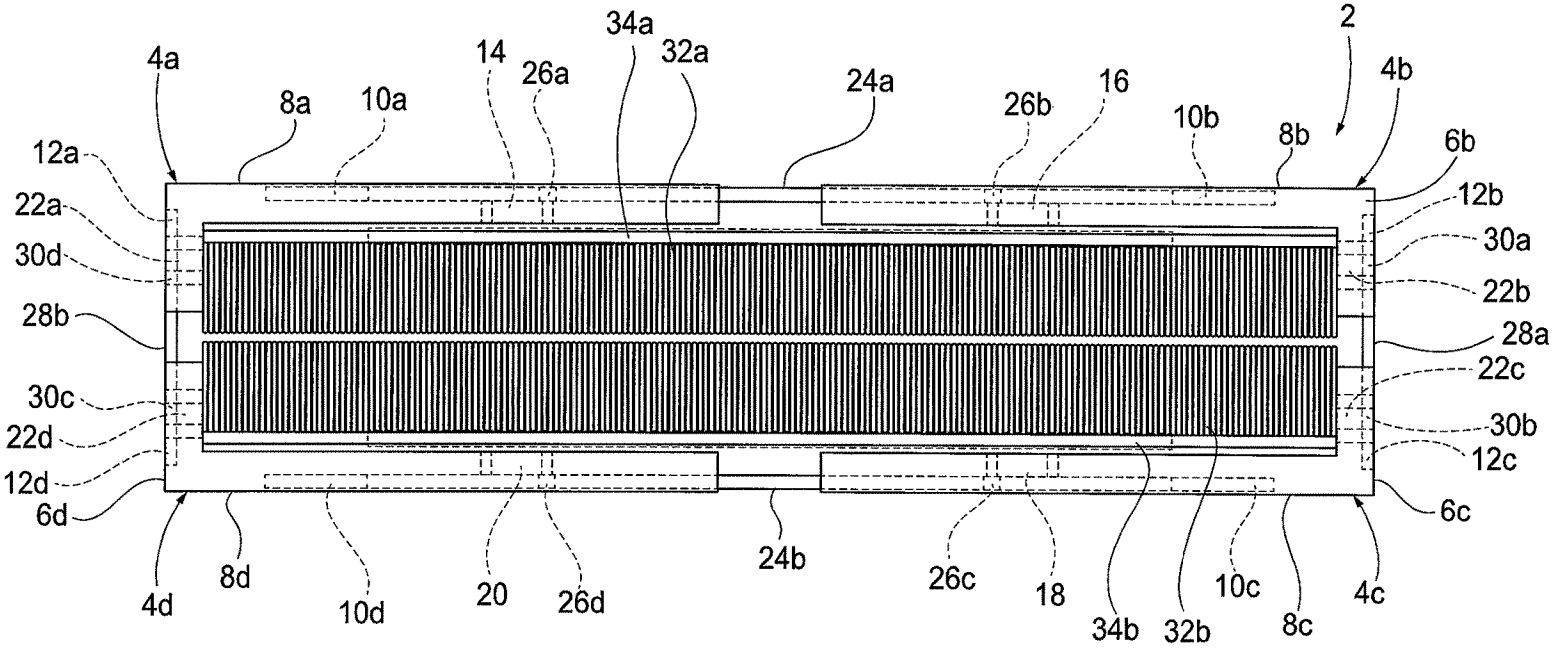
FIG. 12 is a front view of the adjustable mail slot insert of FIG. 11.
Figure 13:
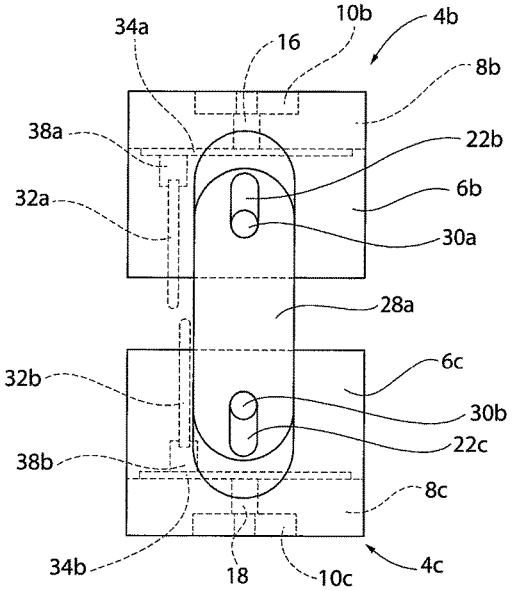
FIG. 13 is a side view of the adjustable mail slot insert of FIG. 11.

The insert 2 may also include at least two side adjusting members 28*a*, 28*b*. As shown in FIG. 6, the side adjusting members 28*a*, 28*b* may be substantially rectangular with rounded ends. As shown in FIG. 1, a right side adjusting member 28*a* may extend from one side leg 6*b* to an opposing side leg 6*c*. A left side adjusting member 28*b* may extend from one side leg 6*a* to an opposing side leg 6*d*. Each side adjusting member 28*a*, 28*b* may define at least two apertures 30*a*-30*d*. It is also contemplated, however, that additional apertures may be defined in the right and left side adjusting members 28*a*, 28*b*.

During operation of the insert 2, the apertures 30*a*, 30*b* on the right side adjusting member 28*a* may be positioned above the apertures 22*b*, 22*c*, respectively, of the right side legs 6*b*, 6*c*. A retaining member (not shown) may be inserted through the apertures 30*a*, 30*b* and the apertures 22*b*, 22*c*, respectively, to retain or hold the right side adjusting member 28*a* in channels 12*b*, 12*c*. The apertures 30*c*, 30*d* of the left side adjusting member 28*b* may be positioned above the apertures 22*d*, 22*a*, respectively, of the left side legs 6*a*, 6*d*. A retaining member (not shown) may be inserted through the apertures 30*c*, 30*d* and the apertures 22*d*, 22*a*, respectively, to retain or hold the left side adjusting member 28*b* in channels 12*a*, 12*d*. The retaining member may be a pin, screw, bolt, or any other similar member configured to hold two objects together.

Figure 14:
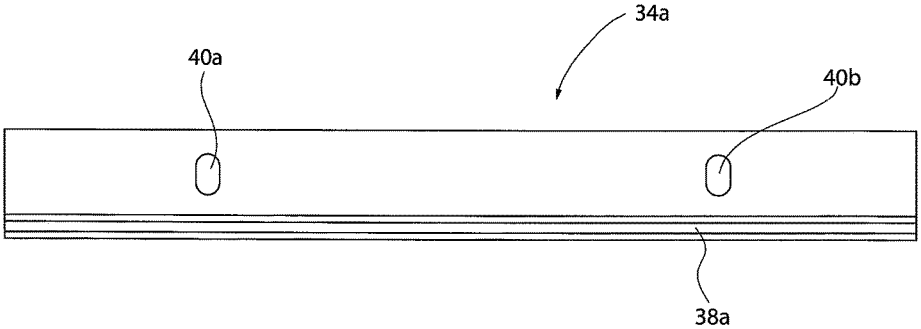
FIG. 14 is a top view of a brush holder in accordance with one aspect of this disclosure.
Figure 15:
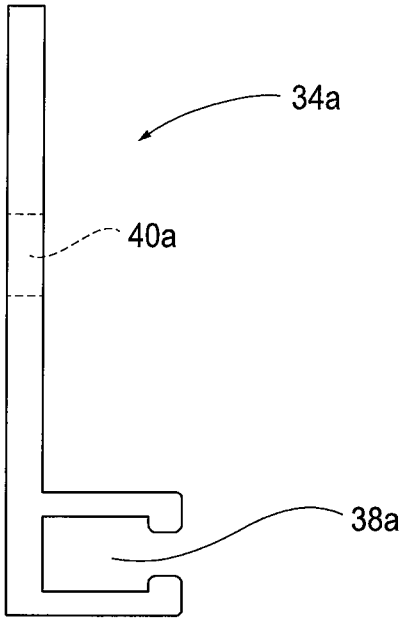
FIG. 15 is a side view of the brush holder of FIG. 14.
Figure 16:
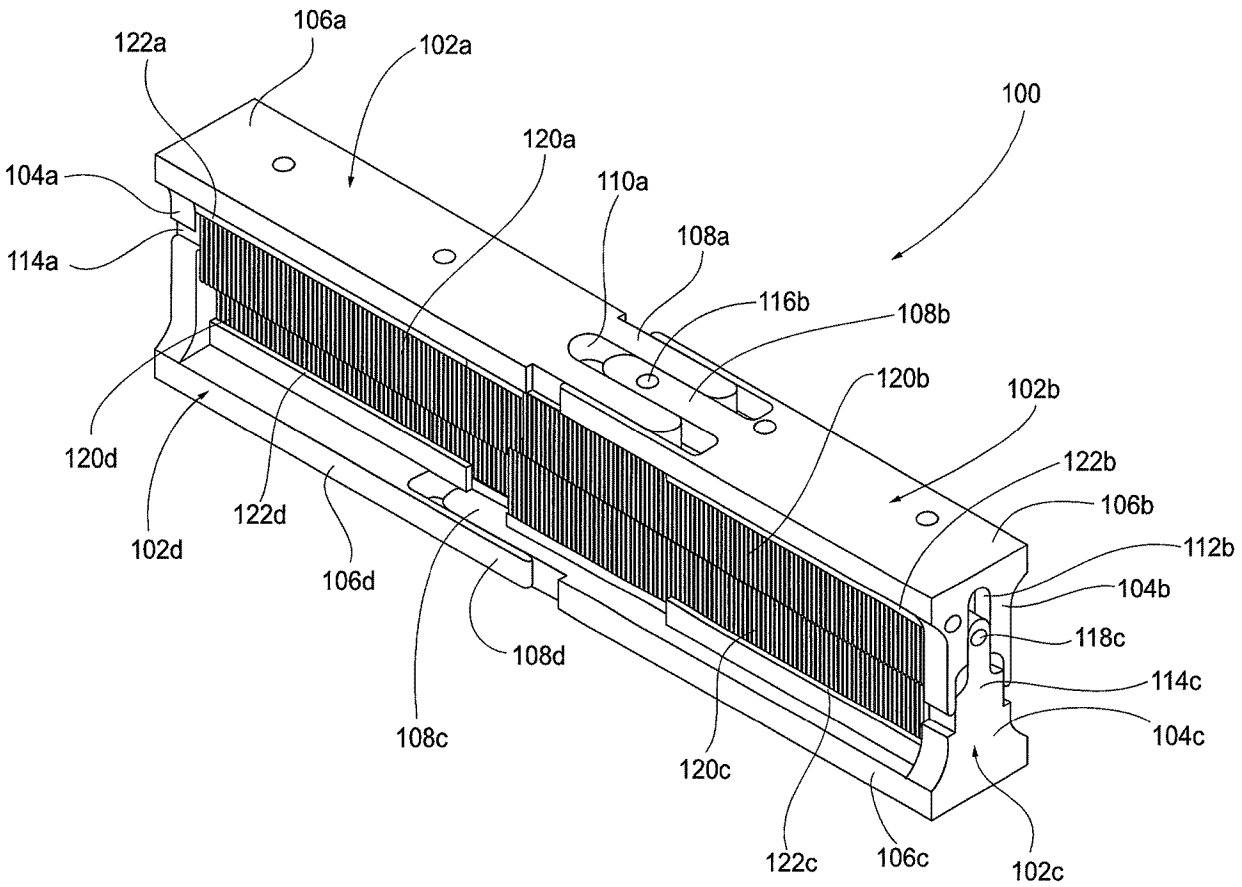
FIG. 16 is a front perspective view of an adjustable mail slot insert in accordance with another aspect of this disclosure.
Figure 17:
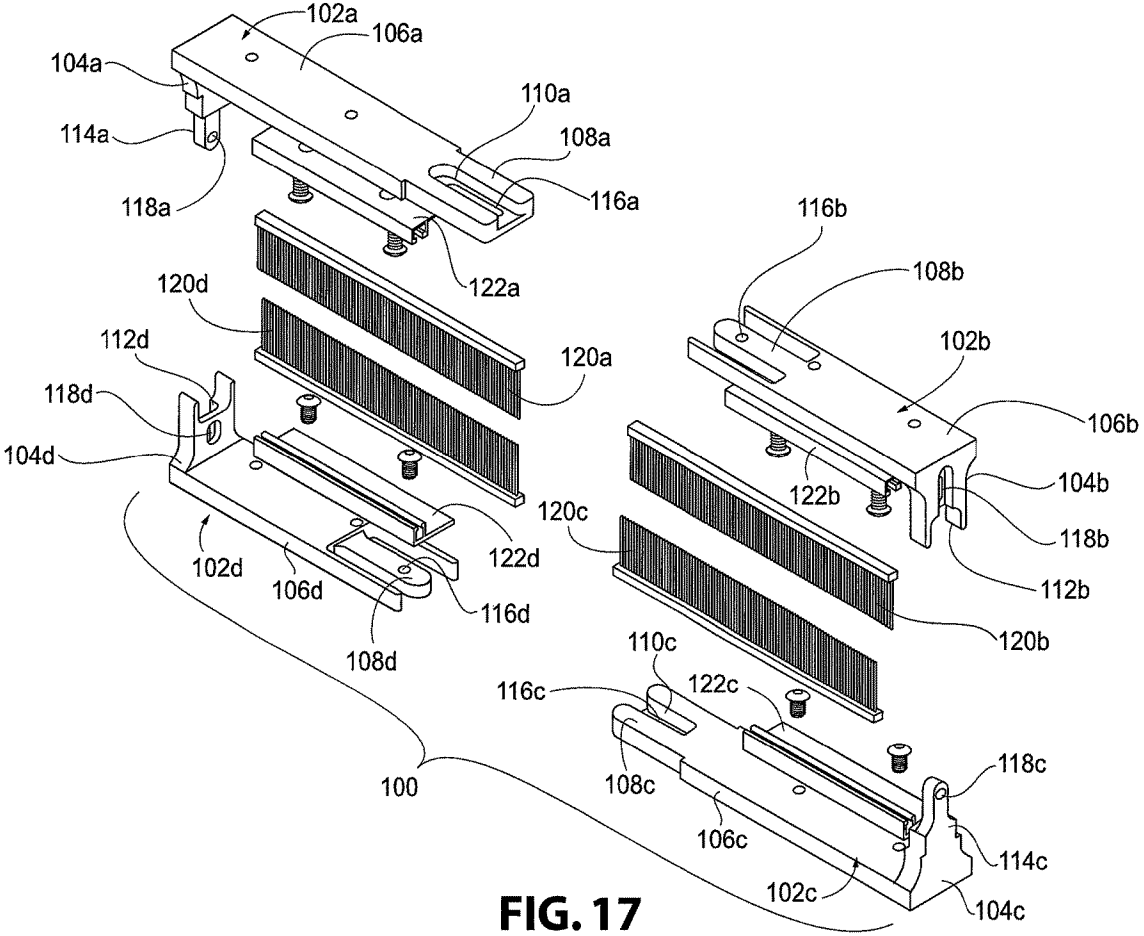
FIG. 17 is an exploded view of the adjustable mail slot insert of FIG. 16.
Figure 18:
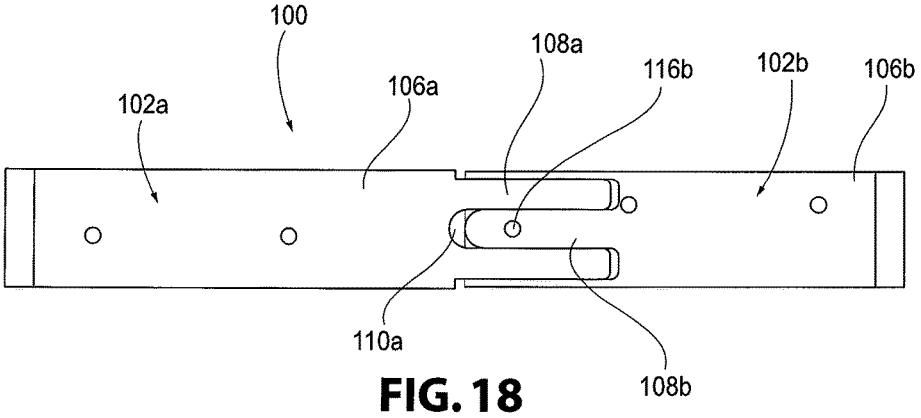
FIG. 18 is a top view of the adjustable mail slot insert of FIG. 16.
Figure 19:
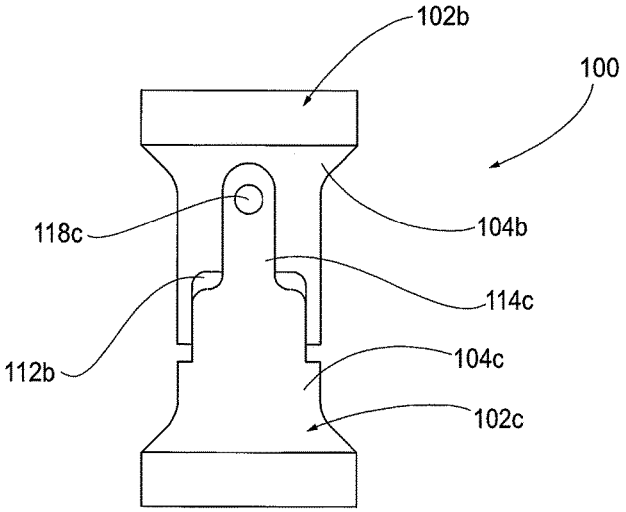
FIG. 19 is a side view of the adjustable mail slot insert of FIG. 16.
Figure 20:
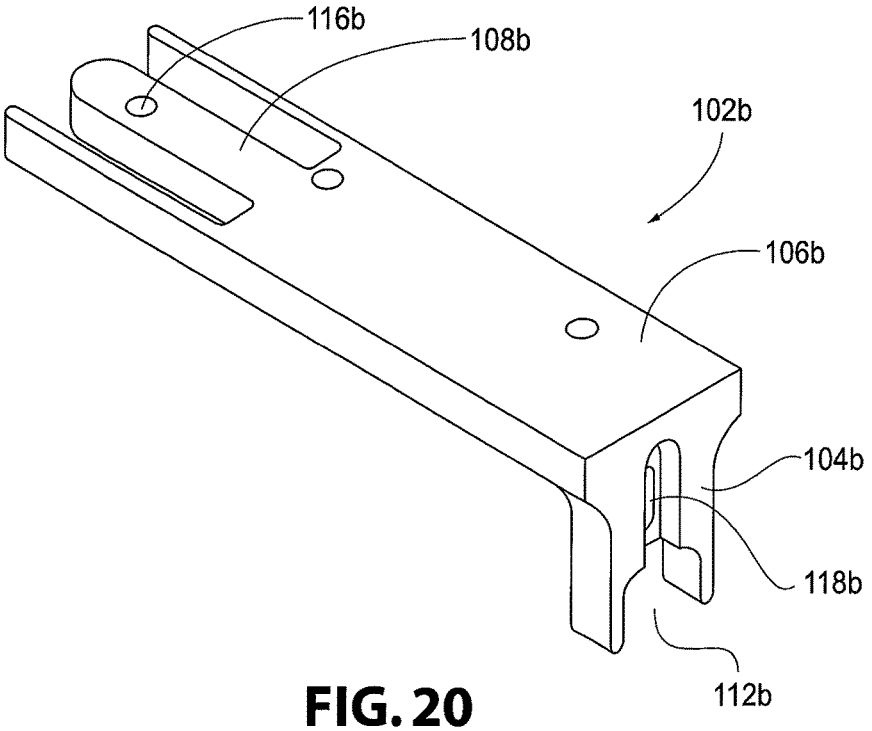
FIG. 20 is a front perspective view of a frame member of the adjustable mail slot insert of FIG. 16.
Figure 21:
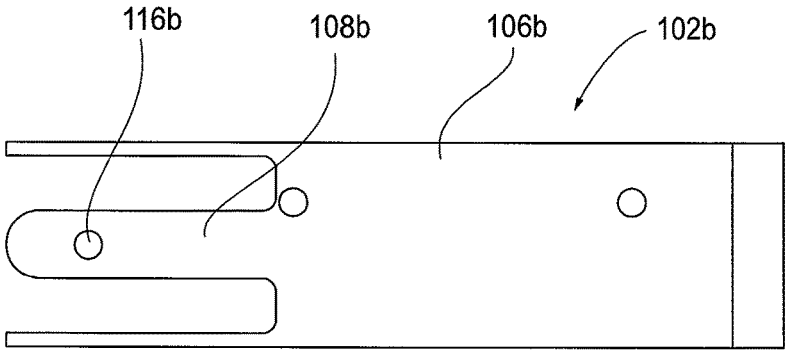
FIG. 21 is a top view of the frame member of FIG. 20.
Figure 22:
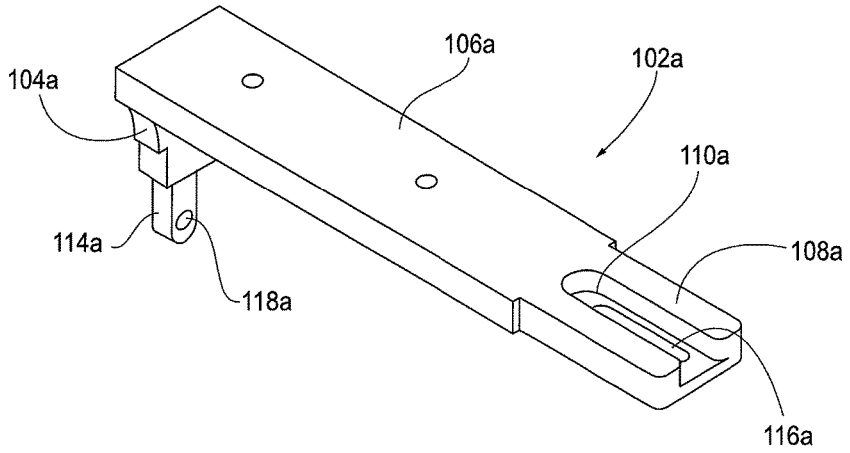
FIG. 22 is a front perspective view of another frame member of the adjustable mail slot insert of FIG. 16.
Figure 23:
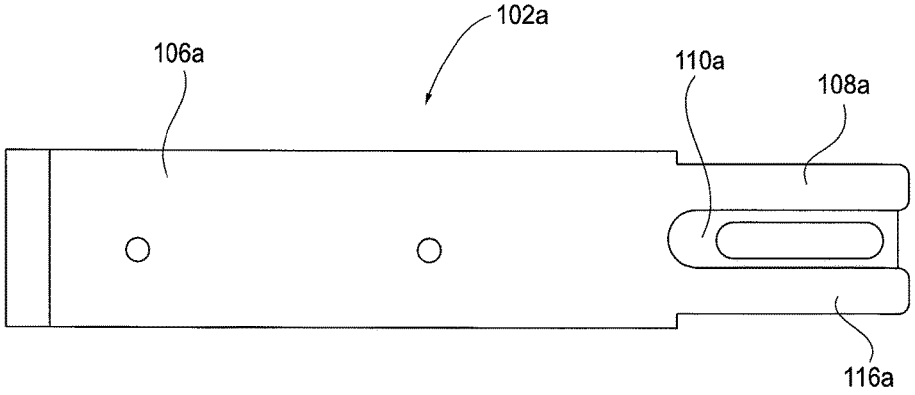
FIG. 23 is a top view of the frame member of FIG. 22.
Figure 24:
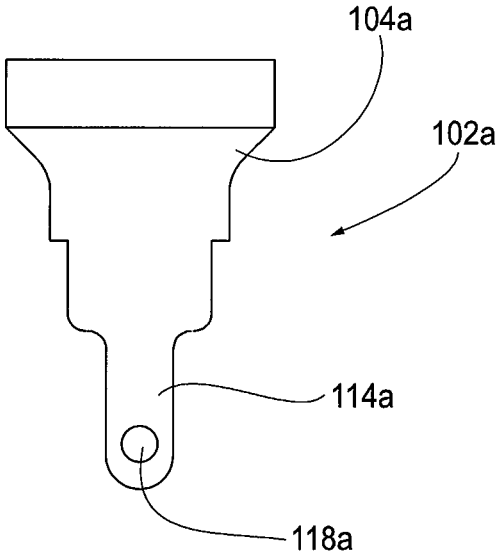
FIG. 24 is a side view of the frame member of FIG. 22.

As explained with reference to FIGS. 11-15, the insert 2 may also include at least two brush attachments 32*a*, 32*b*. It is also contemplated that additional or fewer brush attachments may be used with the insert 2. In one aspect, the brush attachments 32*a*, 32*b* may be attachments consisting of bristles, hair, or wire held in a body, which permit objects to be cleaned or dusted or prevent air and dust particles from entering or exiting a building. The brush attachments 32*a*, 32*b* are held in the insert 2 using brush holders 34*a*, 34*b* that are attached to the insert 2. In particular, a first brush holder 34*a* may be attached to the top legs 8*a*, 8*b* of the insert 2. As shown in FIG. 14, the first brush holder 34*a* may include apertures 40*a*, 40*b* that line up with the apertures 14, 16 of the top legs 8*a*, 8*b* of the insert 2 and the apertures 26*a*, 26*b* of the top adjusting member 24*a*. In this configuration, a retaining member (not shown) may be inserted through the apertures to hold all of the components together. A second brush holder 34*b* may be attached to the bottom legs 8*c*, 8*d* of the insert 2. The second brush holder 34*b* may also include apertures that line up with the apertures 18, 20 of the bottom legs 8*c*, 8*d* of the insert 2 and the apertures 26*c*, 26*d* of the bottom adjusting member 24*b*. A retaining member (not shown) may be inserted through the apertures to hold all of the components together.

The brush attachments 32*a*, 32*b* may be removably inserted into a channel 38 on the brush holders 34*a*, 34*b*. By removably inserting the brush attachments 32*a*, 32*b* into the channel 38, the brush attachments 32*a*, 32*b* may be later removed for cleaning, repair, or replacement. When the brush attachments 32*a*, 32*b* are inserted into the brush holders 34*a*, 34*b* and properly positioned in the insert 2, the brush attachments 32*a*, 32*b* extend into a cavity 36 defined by the insert 2 that passes through the insert 2. The cavity 36 enables objects to be passed through the insert 2.

A method of using the insert 2 is now described with reference to FIG. 1. The insert 2 is configured for use in any type of door, wall, or window, regardless of the dimensions of the mail slot (not shown) that is defined in the door, wall, or window. The insert 2 may be adjusted to fit the size of the mail slot defined in the door, wall, or window. During use of the insert 2, the insert 2 is placed in the mail slot before adjustment of the insert 2. The insert 2 is configured to be adjustable in a vertical and/or a horizontal direction so that the height and width of the insert 2 may be adjusted to the height and width of the mail slot. After the insert 2 has been provided in the mail slot, an individual may move the top legs 8*a*, 8*b* relative to one another and the bottom legs 8*c*, 8*d* relative to one another. The top and bottoms legs 8*a*-8*d* may be moved in a horizontal or lateral direction so as to shorten or lengthen the width of the insert 2. In this manner, the width of the insert 2 may be adjusted to match the width of the mail slot. During this operation, the top adjusting member 24*a* may slide within the channels 10*a*, 10*b* of the top legs 8*a*, 8*b*. Likewise, the bottom adjusting member 24*b* may slide within the channels 10*c*, 10*d* of the bottom legs 8*c*, 8*d*. After the top and bottom legs 8*a*-8*d* have been adjusted to the desired width and position, retaining members may be inserted through the apertures 14 and 26*a* and the apertures 16 and 26*b* to lock or hold the adjusting member 24*a* in place. Likewise, retaining members may be inserted through the apertures 18 and 26*c* and the apertures 20 and 26*d* to lock or hold the adjusting member 24*b* in place.

In a similar manner, the height of the insert 2 may be adjusted according to the height of the mail slot. The right side legs 6*b*, 6*c* may be moved relative to one another in a vertical direction so as to shorten or lengthen the height of the insert 2. Likewise, the left side legs 6*a*, 6*d* may be moved relative to one another in a vertical direction so as to shorten or lengthen the height of the insert 2. During this operation, the right side adjusting member 28*a* may slide within the channels 12*b*, 12*c* of the right side legs 6*b*, 6*c*. In a similar manner, the left side adjusting member 28*b* may slide within the channels 12*a*, 12*d* of the left side legs 6*a*, 6*d*. After the side legs 6*a*-6*d* have been adjusted to the desired height and position, retaining members may be inserted through the apertures 22*b* and 30*a* and the apertures 22*c* and 30*b* to hold or retain the right side adjusting member 28*a* in place. Likewise, retaining members may be inserted through the apertures 22*a* and 30*d* and the apertures 22*d* and 30*c* to hold or retain the left side adjusting member 28*b* in place.

By adjusting the height and width of the insert 2, the insert 2 may be used in any type of door, wall, or window. Regardless of the size of the mail slot, the insert 2 may be adjusted to fit within the mail slot. Therefore, the dimensions of the insert 2 may be enlarged or shortened to fit within the mail slot. By adjusting the insert 2 to fit in the mail slot, any air gaps formed between the insert 2 and the mail slot are eliminated. Therefore, cold and/or hot air is prevented from entering the building through any air gaps between the insert 2 and the mail slot, which air gaps may be formed when the insert 2 is not properly dimensioned to the size of the mail slot. It is also contemplated that the insert 2 may include a hinged door or lid that would block either the front side of the insert 2, the rear side of the insert 2, or both the front and rear sides of the insert 2 so that air is prevented from passing through the cavity 36 of the insert 2 unless the hinged door or lid is opened.

With reference to FIGS. 16-24, another aspect of an adjustable mail slot insert 100 (hereinafter referred to as "the insert 100") is described. The insert 100 shown in FIGS. 16-24 is similar to the insert 2 shown in FIGS. 1-15 but includes several differences that are described below. The method of use of the insert 100 is also similar to the method of use of the insert 2, with a few differences that are described below. The insert 100 is desirably adapted for use in a door of a residential home, office building, or post office. However, it is to be understood that the insert 100 may be used in various other environments, such as a window or an opening defined in a wall. The insert 100 is formed from four separate frame members, 102*a*-102*d*. In one aspect, the insert 100 may be made of plastic or a plastic-like material. It is also contemplated that the insert 100 may be made from alternative types of materials, such as metal.

In one aspect, the four frame members 102*a*-102*d* may be substantially "L-shaped" so as to form a substantially rectangular insert 100. It is also contemplated that the frame members 102*a*-102*d* may form a substantially square insert. Each frame member 102*a*-102*d* may include a side leg 104*a*-104*d*, respectively. The first and second frame members 102*a*, 102*b* may also include a top leg 106*a*, 106*b* that extends substantially perpendicular to the side legs 104*a*, 104*b*. In one aspect, the side legs 104*a*, 104*b* may be shorter than the top legs 106*a*, 106*b*. The third and fourth frame members 102*c*, 102*d* may also include a bottom leg 106*c*, 106*d* that extends substantially perpendicular to the side legs 104*c*, 104*d*. In one aspect, the side legs 104*c*, 104*d* may be shorter than the bottom legs 106*c*, 106*d*.

As shown in FIGS. 17, 18, and 22-24, the top leg 106*a* and the bottom leg 106*c* may each include a protrusion 108*a*, 108*c* that defines a channel 110*a*, 110*c*. As shown in FIGS. 17, 18, 20, and 21, the top leg 106*b* and the bottom leg 106*d* may each include a corresponding protrusion 108*b*, 108*d* that may be received within the channels 110*a*, 110*c* defined by the top leg 106*a* and the bottom leg 106*c*, respectively. In a similar fashion, the side legs 104*b*, 104*d* of the frame members 102*b*, 102*d* may each define a channel 112*b*, 112*d*. The side legs 104*a*, 104*c* of the frame members 102*a*, 102*c* may include a protrusion 114*a*, 114*c* that is received within the channels 112*b*, 112*d*.

The frame members 102*a*-102*d* may be adjusted in a vertical direction and a horizontal direction to adjust the size and dimensions of the insert 100. The top frame members 102*a*, 102*b* and the bottom frame members 102*c*, 102*d* may be moved towards or away from one another in a horizontal direction to adjust the width of the insert 100. As the frame members 102*a*-102*d* are moved relative to one another, the protrusions 108*b*, 108*d* on the frame members 102*b*, 102*d* are moved within the channels 110*a*, 110*c* of the frame members 102*a*, 102*c*. Once the desired width has been obtained, a securing member (not shown), such as a bolt, screw, or rod, may be inserted through holes 116*b*, 116*d* defined in the protrusions 108*b*, 108*d* and into holes 116*a*, 116*c* defined in the channels 110*a*, 110*c*. In a similar fashion, the top frame members 102*a*, 102*b* and the bottom frame members 102*c*, 102*d* may be moved towards or away from one another in a vertical direction to adjust the height of the insert 100. As the frame members 102*a*-102*d* are moved relative to one another, the protrusions 114*a*, 1114*c* on the frame members 102*a*, 102*c* may be moved within the channels 112*b*, 112*d* of the frame members 102*b*, 102*d*. Once the desired height has been obtained, a securing member (not shown), such as a bolt, screw, or rod, may be inserted through holes 118*a*, 118*c* defined in the protrusions 114*a*, 114*c* and into holes 118*b*, 118*d* defined in the channels 112*b*, 112*d*. This aspect of the insert 100 does not require adjusting members to adjust the dimensions of the insert 100.

According to this aspect of the insert 100, a plurality of brush attachments 120*a*-120*d* may be provided within the insert 100. A brush attachment 120*a*-120*d* may be provided on each frame member 102*a*-102*d*. Each brush attachment 120*a*-120*d* may be held by a brush holder 122*a*-122*d* that are connected to each respective frame member 102*a*-102*d*. The brush holders 122*a*-122*d* are similar to the brush holders 34*a*, 34*b* used in the insert 2. In one aspect, the brush attachments 120*a*-120*d* may be positioned in the insert 100 so as to be offset from one another to create a staggered arrangement of brush attachments 120*a*-120*d* in the insert 100. The brush attachments 120*a*-120*d* may be removably inserted into the brush holders 122*a*-122*d*. By removably inserting the brush attachments 120*a*-120*d* into the brush holders 122*a*-122*d*, the brush attachments 120*a*-120*d* may be later removed for cleaning, repair, or replacement. When the brush attachments 120*a*-120*d* are inserted into the brush holders 122*a*-122*d* and properly positioned in the insert 100, the brush attachments 120*a*-120*d* extend into a cavity defined by the insert 100 that passes through the insert 100. The cavity enables objects to be passed through the insert 100.

While various aspects of the adjustable mail slot insert were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of the any other aspect. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. An adjustable mail slot insert for insertion into a door or wall, comprising:

two top mail slot insert frame members movably connected to one another, each top mail slot insert frame member comprising a side leg and a top leg;

two bottom mail slot insert frame members movably connected to one another, each bottom mail slot insert frame member comprising a side leg and a bottom leg, wherein one top mail slot insert frame member is movably connected to one bottom mail slot insert frame member and another top mail slot insert frame member is movably connected to another bottom mail slot insert frame member, the door or wall defining an opening, and wherein, when inserted in the opening of the door or the wall, the insert is adjustable in a horizontal direction, a vertical direction, or the horizontal direction and the vertical direction through movement of the mail slot insert frame members relative to one another.

2. The adjustable mail slot insert as claimed in claim 1, further comprising:

a top adjusting member that extends between the top legs of the top frame members;

a bottom adjusting member that extends between the bottom legs of the bottom frame members;

a right side adjusting member that extends between the right side legs of the top frame member and the bottom frame member; and a left side adjusting member that extends between the left side legs of the top frame member and the bottom frame member.

3. The adjustable mail slot insert as claimed in claim 1, wherein:

the side leg of one of the top mail slot insert frame members comprises a first protrusion extending therefrom;

the side leg of the other top mail slot insert frame member defines a first channel therein;

the side leg of one of the bottom mail slot insert frame members comprises a second protrusion extending therefrom;

the side leg of the other bottom mail slot insert frame member defines a second channel therein;

the first protrusion is inserted into the second channel; and the second protrusion is inserted into the first channel.

4. The adjustable mail slot insert as claimed in claim 1, wherein:

the top leg of one of the top mail slot insert frame members defines a first channel therein;

the top leg of the other top mail slot insert frame member comprises a first protrusion extending therefrom;

the bottom leg of one of the bottom mail slot insert frame members comprises a second protrusion extending therefrom;

the bottom leg of the other bottom mail slot insert frame member defines a second channel therein, the first protrusion is inserted into the first channel; and the second protrusion is inserted into the second channel.

5. The adjustable mail slot insert as claimed in claim 1, further comprising at least one brush attachment positioned on at least one of the top mail slot insert frame members and the bottom mail slot insert frame members.

6. The adjustable mail slot insert as claimed in claim 5, wherein the at least one brush attachment is positioned across the top mail slot insert frame members or the bottom mail slot insert frame members.

7. The adjustable mail slot insert as claimed in claim 5, wherein a brush attachment is positioned on each top mail slot insert frame member and each bottom mail slot insert frame member.

8. The adjustable mail slot insert as claimed in claim 7, wherein the brush attachments are offset relative to one another when positioned in the adjustable mail slot insert.

9. The adjustable mail slot insert as claimed in claim 5, further comprising at least one brush holder to hold the at least one brush attachment on at least one of the top mail slot insert frame members and the bottom mail slot insert frame members.

10. The adjustable mail slot insert as claimed in claim 9, wherein the at least one brush holder defines a channel to receive and retain the at least one brush attachment within the at least one brush holder.

11. The adjustable mail slot insert as claimed in claim 5, wherein the at least one brush attachment is removably positioned on at least one of the top mail slot insert frame members and the bottom mail slot insert frame members.

12. The adjustable mail slot insert as claimed in claim 1, wherein the adjustable mail slot insert has a substantially rectangular cross-section.

13. The adjustable mail slot insert as claimed in claim 1, wherein a height corresponding to the vertical direction of the mail slot insert and a width corresponding to the horizontal direction of the mail slot insert of the adjustable mail slot insert are adjustable.

14. The adjustable mail slot insert as claimed in claim 1, wherein the top mail slot insert frame members and the bottom mail slot insert frame members are substantially L-shaped.

15. An adjustable mail slot insert, comprising:

two top frame members movably connected to one another, each top frame member comprising a side leg and a top leg;

two bottom frame members movably connected to one another, each bottom frame member comprising a side leg and a bottom leg; and at least one attachment positioned on at least one of the top frame members and the bottom frame members to prevent air and dust particles from entering or exiting an opening defined by the frame members, wherein one top frame member is movably connected to one bottom frame member and another top frame member is movably connected to another bottom frame member, wherein the insert is adjustable in a horizontal direction, a vertical direction, or the horizontal direction and the vertical direction through movement of the frame members relative to one another, and wherein the at least one attachment comprises at least one brush attachment.

16. An adjustable mail slot insert, comprising:

two top frame members movably connected to one another, each top frame member comprising a side leg and a top leg;

two bottom frame members movably connected to one another, each bottom frame member comprising a side leg and a bottom leg, wherein one top frame member is movably connected to one bottom frame member and another top frame member is movably connected to another bottom frame member, wherein the insert is adjustable in a horizontal direction and a vertical direction through movement of the frame members relative to one another, wherein the side leg of one of the top frame members comprises a first protrusion extending therefrom, the first protrusion defining a first hole configured to receive a first retaining member, wherein the side leg of the other top frame member defines a first channel therein, the first channel defining a second hole configured to receive a second retaining member, wherein the side leg of one of the bottom frame members comprises a second protrusion extending therefrom, the second protrusion defining a third hole configured to receive the second retaining member, wherein the side leg of the other bottom frame member defines a second channel therein, the second channel defining a fourth hole configured to receive the first retaining member, wherein the first protrusion is inserted into the second channel; and wherein the second protrusion is inserted into the first channel.

* * * * *